US009053880B2

(12) United States Patent
LaFountain et al.

(10) Patent No.: US 9,053,880 B2
(45) **Date of Patent: *Jun. 9, 2015**

(54) DOUBLE POLE-DOUBLE THROW PROXIMITY SWITCH

(71) Applicant: General Equipment and Manufacturing Company, Inc., Louisville, KY (US)

(72) Inventors: Robert Lynn LaFountain, Charlestown, IN (US); Gregory Curtis Merrifield, Prospect, KY (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/728,050

(22) Filed: Dec. 27, 2012

(65) Prior Publication Data

US 2013/0234814 A1 Sep. 12, 2013

Related U.S. Application Data

(60) Provisional application No. 61/580,936, filed on Dec. 28, 2011.

(51) Int. Cl.

| | |
|---|---|
| ***H01H 9/00*** | (2006.01) |
| ***H01H 36/00*** | (2006.01) |
| ***H01H 9/04*** | (2006.01) |

(52) U.S. Cl.

CPC ..... *H01H 36/0073* (2013.01); *H01H 9/04* (2013.01); *H01H 36/00* (2013.01); *H01H 2231/044* (2013.01)

(58) Field of Classification Search

CPC ..... H01H 36/00; H01H 36/00073; H01H 50/023; H01H 50/02

USPC ..... 361/600, 679.01, 807–810; 335/205–207; 324/207.11–207.26

See application file for complete search history.

(56) References Cited

U.S. PATENT DOCUMENTS 3,219,811 A 11/1965 Young
4,117,431 A * 9/1978 Eicher ..... 335/207

(Continued)

FOREIGN PATENT DOCUMENTS

DE 102 37 904 A1 1/2004
GB 1 217 677 A 12/1970

OTHER PUBLICATIONS

International Search Report and Written Opinion for Application No. PCT/US2012/070814, dated Jun. 3, 2013.

(Continued)

*Primary Examiner* — Bernard Rojas
(74) *Attorney, Agent, or Firm* — Marshall, Gerstein & Borun LLP

(57) ABSTRACT

Proximity switches include a hermetically sealed unit that can be used in harsh environments and under significant pressures, such as underwater and in nuclear power facilities, without having any parts that would require replacement or periodic maintenance. The proximity switches are preferably switches actuated by physical movement of a contact in response to changing magnetic forces. The switches are preferably disposed in a body tube optionally including a hermetic seal assembly to seal an open end of the body tube and/or a ferrule that prevents electrical wires attached to the switch inside the body tube from being pulled away from the switch. Further, the switches preferably maintain a contact pressure between electrical contacts sufficient to withstand acceleration seismic testing of 10 g with no contact discontinuity.

10 Claims, 7 Drawing Sheets

(56) References Cited

U.S. PATENT DOCUMENTS

| | | | | |
|---|---|---|---|---|
| 4,788,517 | A | 11/1988 | Meister | |
| 4,837,539 | A * | 6/1989 | Baker | 335/207 |
| 5,798,910 | A | 8/1998 | Holbeche et al. | |
| 6,127,910 | A * | 10/2000 | Webb et al. | 335/205 |
| 6,299,426 | B1 | 10/2001 | Scanlan | |
| 7,489,217 | B2 * | 2/2009 | Rohrig et al. | 335/205 |
| 8,439,404 | B2 * | 5/2013 | Anton et al. | 285/93 |
| 2013/0169388 | A1 * | 7/2013 | LaFountain et al. | 335/205 |

OTHER PUBLICATIONS

International Preliminary Report on Patentability for International application No. PCT/US2012/070814, dated Jul. 10, 2014.

Written Opinion for International application No. PCT/US2012/070814, dated Jul. 10, 2014.

* cited by examiner

DOUBLE POLE-DOUBLE THROW PROXIMITY SWITCH

BACKGROUND

1. Field of the Disclosure

The invention generally relates to electrical switches and more specifically to double pole-double throw proximity switches for use in nuclear environments.

2. Related Technology

Nuclear reactors require robust control systems to ensure that the nuclear reaction can be shut down in any emergency. In extreme emergencies, such as containment vessel breaches, nuclear reactors can experience a loss of cooling fluid, which could potentially lead to a runaway nuclear reaction (i.e., nuclear meltdown). In such situations, the control systems of the nuclear reactor must be capable of shutting down the nuclear reactor regardless of damage or other non-normal operating conditions. To ensure that the control systems are capable of shutting down the nuclear reaction in any situation, control system components are subject to rigorous testing conditions.

One component of control systems is a proximity or limit switch. The proximity or limit switch may use magnetic attraction to complete various electronic circuits based on the proximity of a target. For example, during a loss of coolant, a coolant level sensor (such as a float sensor) may gradually approach the proximity switch. When the sensor reaches the sensor's maximum detection range, the sensor may complete various electronic circuits that indicate loss of coolant and/or that begin a shutdown sequence for the nuclear reactor. These proximity switches must be capable of detecting the target during extreme conditions. As a result, many regulatory agencies require proximity switches used in nuclear operations to pass rigorous tests. One of these tests is a seismic test where the proximity switch is subject to violent accelerations of up to 10 g to simulate conditions in an earthquake. The proximity switch must survive the seismic testing with no contact discontinuity.

One type of switch that has been shown to pass the rigorous tests required for nuclear operation is a high amp rated mechanical switch, one of which is manufactured by NAMCO®. However, these high amp rated mechanical switches suffer from various drawbacks, such as low performance at low current (due to resistance problems), requiring a lever arm that connects to the target, complicated internal moving parts (e.g., springs, cams, and the like), multiple points of potential contamination ingression, supplementary repair and regular maintenance of the internal moving components, and a short service life, generally less than about 9 years.

SUMMARY OF THE DISCLOSURE

A proximity switch includes a body tube having a blind bore, a closed end, and an open end; a magnetic proximity switch assembly disposed inside the blind bore; a hermetic seal covering the blind bore between the magnetic proximity switch assembly and the open end; a crush ring disposed against an annular shoulder defined in a surface of the blind bore between the hermetic seal and the open end; a crush ring compression device having a threaded plug body that screws into the open end of the blind bore and sealingly engages the crush ring; and a potting filling space between the crush ring compression device and the hermetic seal. The hermetic seal, the potting, and the crush ring compression device seal the blind bore and protect the magnetic proximity switch during pressurization and submergence testing or during exposure to harsh environmental factors.

The crush ring optionally may be in the form of a hollow tube having a circular longitudinal axis. The hermetic seal optionally can include a disc sized and shaped to complement the blind bore, and a tube extending through the disc. The tube may include a first end adjacent the magnetic proximity switch and receiving an electrical contact therein. An outer annular periphery of the disc may be sealed to an inner surface of the blind bore. A second tube may extend through the disc, and the second tube may receive a second electrical contact therein.

In another option, an electrical cable is connected to the magnetic proximity switch assembly and the electrical cable extends from the hermetic seal through the crush ring compression device, the electrical cable being electrically coupled to the tube. The crush ring compression device optionally has a central bore, wherein the electrical cable extends through the central bore. The central bore also may include a cylindrical portion and a first tapered portion extending from the cylindrical portion to a first end of the plug body engaged against the crush ring. The crush ring compression device compresses the potting into the central bore.

In another embodiment, a proximity switch may include a body tube having bore with an open end; a proximity switch assembly disposed inside the bore; a plug having a body that fits inside the open end and locks against an annular wall of the bore, the plug body having a second bore therethrough; an electrical lead electrically coupled with the proximity switch assembly and extending through the second bore; a ferrule surrounding the electrical lead and disposed inside the second bore; and a jam nut coupled with the plug and urging the ferrule into sealing contact with the second bore and locking the electrical lead in a fixed position within the second bore.

The ferrule may optionally include a tapered nose that is wedged within the second bore. The plug optionally may include a nipple extending from an exterior end of the plug body axially opposite the proximity switch assembly. The second bore may have a tapered portion extending through the nipple, and the ferrule may be wedged into the tapered portion by the jam nut.

The nipple may optionally include exterior threads, and the jam nut may screw onto the exterior threads. The tapered portion may form a conical bore. In one arrangement, the ferrule optionally is at least partly made of Poly Ether Ether Ketone. In another option, the ferrule sealingly engages the second bore and the electrical lead thereby forming a seal around the electrical lead in the second bore. The jam nut may optionally have an inward radial flange that engages the ferrule.

In yet another embodiment, a proximity switch assembly includes a primary magnet; a plunger including a piston head spaced from the primary magnet and a piston rod connecting the piston head and the primary magnet; an electrical contact carried by the piston head and arranged to open and/or close an electrical circuit upon movement of the piston head; and a biasing magnet located adjacent the piston rod between the primary switch and the piston head. The biasing magnet is arranged to bias the primary magnet axially along the piston rod either toward or away from the biasing magnet, the plunger and the primary magnet are arranged to move axially in relation to the biasing magnet, and no flux sleeve is disposed between the primary magnet and the biasing magnet. The primary magnet may be carried by a retainer attached to the piston rod and the biasing magnet may be carried within a retainer body comprising a wall disposed between the biasing magnet and the retainer. No spacer or ferrous material is disposed between the wall and the retainer.

According to additional aspects, all functionally possible different combinations of components and features shown and described herein are expressly included as additional aspects of the disclosure and contemplated as being separable and individual technological developments that may be combined in various arrangements not expressly shown in the drawings. Other aspects and advantages of the present disclosure will become apparent upon consideration of the following description.

DETAILED DESCRIPTION

Each proximity switch preferably includes a switch assembly having an array of magnets disposed near a face of the switch to create an internal magnetic bias to maintain the switch in a normal first position that completes a first circuit. The first circuit can be either a normally open or a normally closed circuit depending on how the switch assembly is wired. When the internal magnetic bias is interrupted or overpowered, such as by a target made of ferrous metal or preferably magnetized material moved to within a certain distance of the face of the switch, the change in bias causes a set of electrical contacts to shift to a second position that completes a second circuit as long as the target is within the certain distance. When the target is removed from the face of the switch, the array of magnets causes the switch to shift back to the first position and thereby switch back to the first circuit again. As a result, each proximity switch snaps positively between the first and second positions, thereby minimizing or eliminating flutter. Other types of switch assemblies may be used according to some aspects of the present teachings. The proximity switches preferably are provided in a hermetically sealed unit that can be used in harsh environments and under significant pressures, such as underwater and in nuclear power facilities, without having any serviceable parts that would require replacement. Further, the proximity switches preferably maintain a contact pressure in both the first and second positions to withstand acceleration seismic testing of 10 g with no contact discontinuity.

Figure 1:
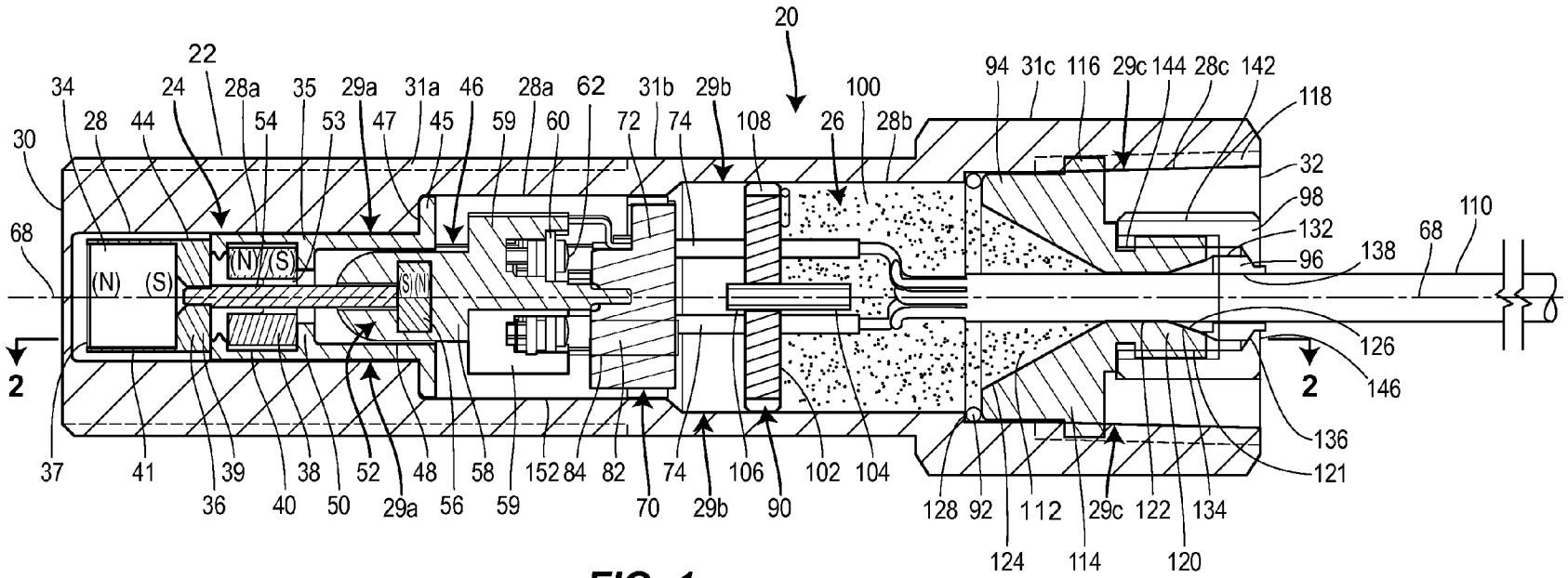
FIG. 1 is a cross-sectional view along a longitudinal axis of a proximity switch.
Figure 2:
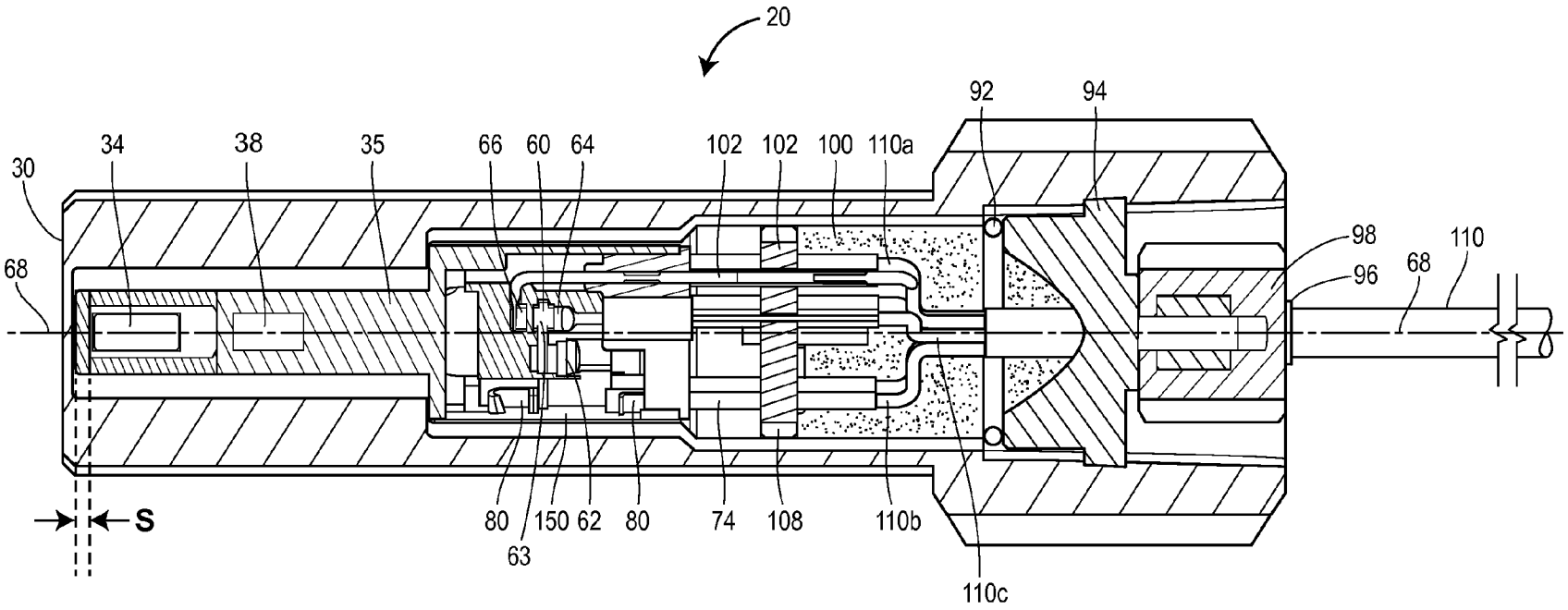
FIG. 2 is a cross-sectional view of the proximity switch of FIG. 1 taken along line 2-2.
Figure 3:
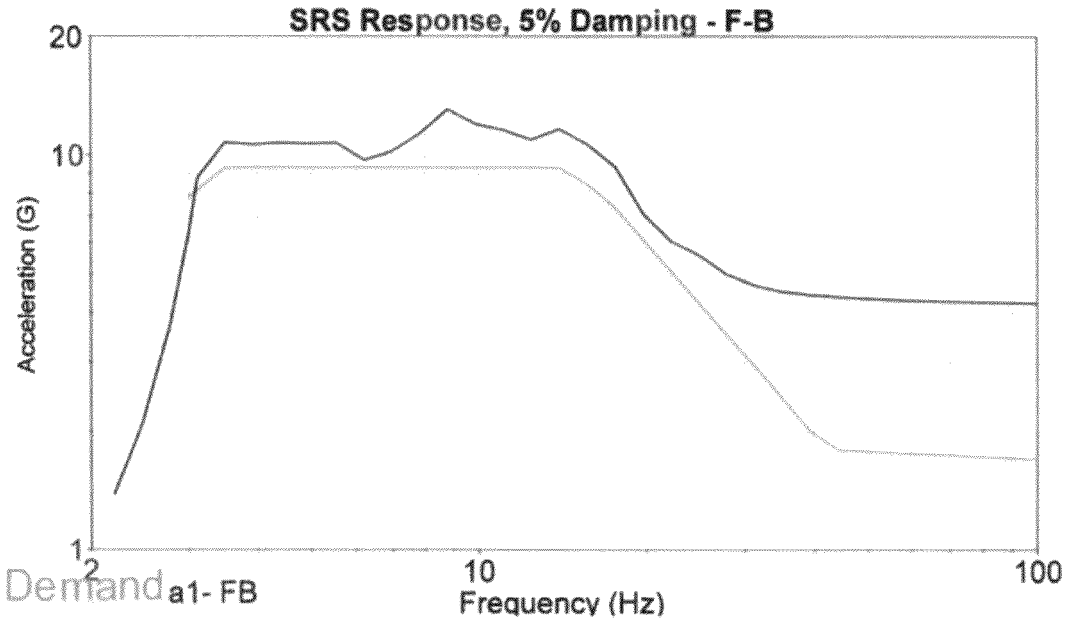
FIG. 3 is a graph of front to back accelerations of the proximity switch.
Figure 4:
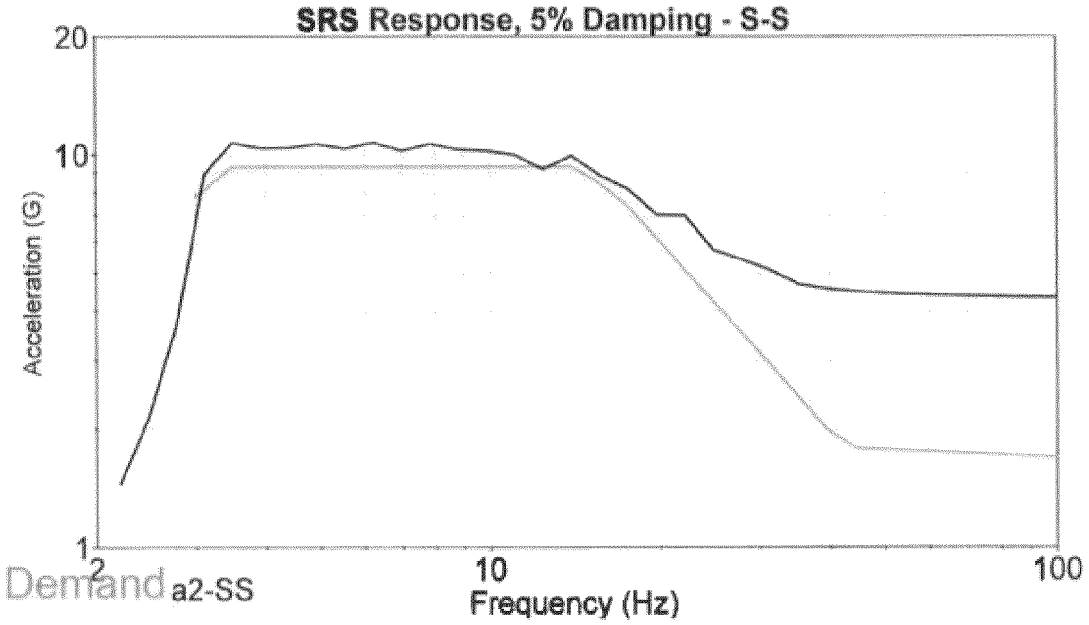
FIG. 4 is a graph of side to side accelerations of the proximity switch.
Figure 5:
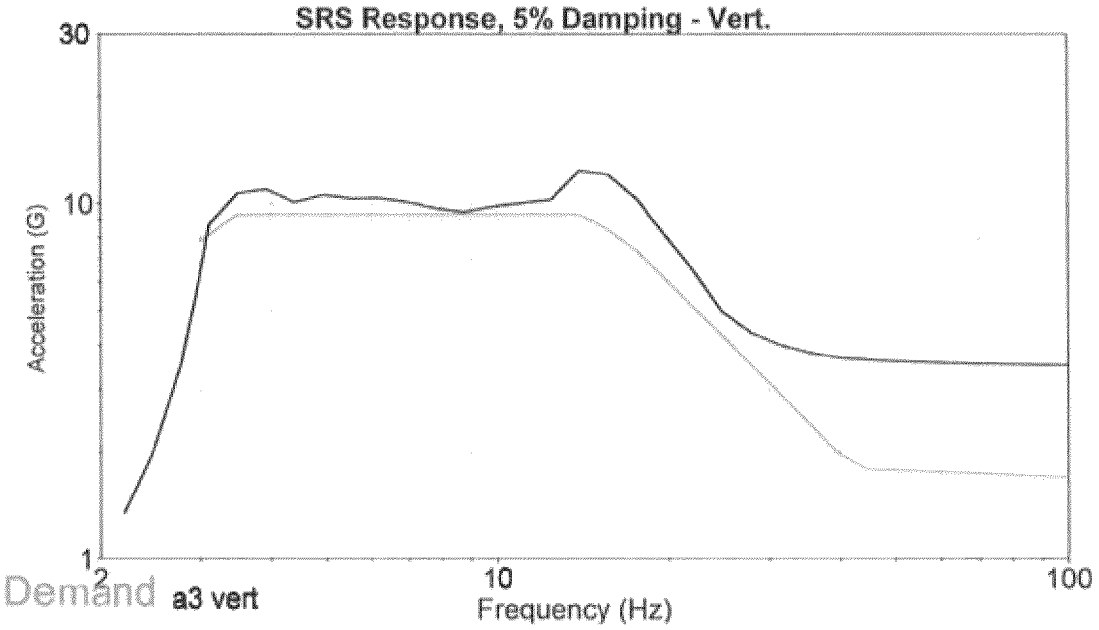
FIG. 5 is a graph of vertical accelerations of the proximity switch.

Turning now to the drawings, FIGS. 1 and 2 illustrate one embodiment of a proximity switch 20. The proximity switch 20 includes a body tube 22, a switch assembly 24 that is received inside the body tube 22, and an optional end seal assembly 26 that hermetically seals the switch assembly 24 within the body tube 22.

The body tube 22 is an elongate hollow tubular member with a blind inner bore 28 extending from a closed end 30 to an open end 32. The body tube 22 and the inner bore 28 may include a first section 28*a* that extends from the closed end 30 towards the open end 32, a second section 28*b* extending from the first section 28*a* towards the open end 32, and third section 28*c* extending from the second section 28*b* to the open end 32. The first section 28*a* has a first inner diameter 29*a* sized to receive the switch assembly 24, the second section 28*b* has a second inner diameter 29*b* larger than the first diameter 29*a*, and the third section 28*c* has a third diameter 29*c* larger than the second diameter 29*b*. The second and third diameters 29*b*, 29*c* are sized to receive different portions of the end seal assembly 26 as explained in detail below. In some embodiments, the third section 28*c* may not have a constant inner diameter, rather, the third section 28*c* may have an inner diameter that is largest proximate the open end 32, the inner diameter tapering inwardly towards the second section 28*b*. The outer surface of the body tube 22 preferably has the shape of a stud with a middle portion 31*b* being located between a threaded shaft 31*a* and a head 31*c*. Preferably, an outer surface of the body tube 22, along at least a portion of the first section 28*a* is threaded in order to be threadedly received within a bore of, for example, a valve body, cylinder head, or any other item that is adapted to use a proximity switch as would be apparent to one of ordinary skill. An outer surface of the body tube 22 along at least a portion of the third section 28*c* preferably has the form of a bolt head, such as a standard hex-head bolt head. The body tube 22 may have different sizes and dimension depending on the requirements of a particular use environment. In the arrangement depicted in the drawings, the body tube 22 has an axial length of about 4 inches from the end wall 30 to the open end 32 and may be made of metal, such as stainless steel, sufficient to endure harsh operating environments. In other embodiments, the body tube 22 may be made of other materials, such as carbon fiber or other composite materials that are capable of withstanding the rigorous testing conditions described herein.

The switch assembly 24 has a generally cylindrical jacket 35 when assembled that fits into the first section 28*a* of the inner bore 28. The switch assembly 24 includes a primary magnet 34 disposed at a first end 37 of the cylindrical jacket 35. The cylindrical jacket 35 may include an annular flange 45 at one end, generally opposite the primary magnet 34 that seats against a corresponding inner shoulder 47 located within the inner bore 28. The primary magnet 34 is carried by a retainer 36, which preferably is in the shape of a hollow cylinder with an end wall 39 and a blind bore 41. The primary magnet 34 is received within the blind bore 41 and attached to the end wall 39 by any convenient fastener, such as adhesive, or by press fitting, or other method of attaching one component to another. A biasing magnet 38 is disposed in a first cavity 40 of the cylindrical jacket 35, adjacent to the retainer 36 and within a magnetic flux zone of the primary magnet 34. The biasing magnet 38 is separated from the end wall 39 of the retainer 36 by an end wall 44 of the first cavity 40. In a preferred arrangement, each of the primary magnet 34 and the biasing magnet 38 are permanent magnets and have opposite poles facing each other (i.e., north to south) thereby creating a magnetic attraction to one another, and the cylindrical jacket 35 is made of an electrically insulating material, such as a plastic.

A push/pull plunger assembly 46 is disposed at least partially within a second cavity 48 in the cylindrical jacket 35. A dividing wall 50 separates the second cavity 48 from the first cavity 40. The dividing wall 50 and the end wall 44 positively locating the basing magnet 38 within the first cavity 40 and preventing the biasing magnet from moving within the cylindrical jacket 35. The push/pull plunger assembly 46 includes a piston head assembly 52 and an axial shaft 54 that connects the piston head assembly 52 to the retainer 36. The shaft 54 extends through a central axial bore 53 through the dividing wall 50, through the biasing magnet 38, and through the end wall 44, and is connected to the end wall 39 of the retainer 36 so that the primary magnet 34 and the piston head assembly 52 move together longitudinally within the body tube 22 between a first position and a second position, based on relative magnetic attractions between the primary magnet 34, the biasing magnet 38, and a target outside of the body tube 22.

The piston head assembly 52 includes a second biasing magnet 56 encapsulated within a body 58 made of an electrically insulating material, such as plastic. The body 58 includes one or more fins 59. The fins 59 may be longitudinally oriented and disposed radially about a periphery of the body 58. The fins 59 may cooperate with the annular flange 45 to create a longitudinal stop that limits movement of the push/pull plunger assembly 46 in a longitudinal direction. A gap between the fins 59 and the annular flange 45 may be sized to produce a desired longitudinal range of movement for the push/pull plunger assembly 46.

The second biasing magnet 56 is preferably arranged to have a like magnetic pole facing the biasing magnet 38 (i.e., north-to-north or south-to-south) thereby creating a repelling force between the second biasing magnet 56 and the biasing magnet 38. A combination of the attractive force between the primary magnet 34 and the biasing magnet 38 and the repelling force between the biasing magnet 38 and the second biasing magnet 56 biases the push/pull plunger assembly 46 to a first position in which the primary magnet 34 and the biasing magnet 38 are closest to one another.

A common contact 60, in the form of a thin electrically conductive strip of material, for example, copper, is connected to the piston head assembly 52 by any convenient means, such as a screw 62, so that the common contact 60 moves with the piston head assembly 52. A first end 63 of the common contact is disposed axially between a first circuit contact 64 and a second circuit contact 66. The first circuit contact 64 is spaced apart from the second circuit contact 66 along a longitudinal axis 68 of the switch assembly 24 a distance substantially equal to a stroke length S of the primary magnet 34 and push/pull plunger assembly 46 within the inner bore 28. Preferably, each of the first section 28*a* of the inner bore and the second cavity 48 has a length along the axis 68 that allows space for the primary magnet 34 and the piston head assembly 46 to move axially back and forth a distance equal to the stroke length S, sufficient to allow the common contact 60 to move the distance from connection with the first circuit contact 64 to connection with the second circuit contact 66, and back. In other embodiments, one or more of the common contact 60, the first circuit contact 64 and the second circuit contact 66 may be made of palladium silver with a sawtooth surface configuration to improve electrical conductivity.

A header assembly 70 formed of an electrically insulating material includes a plug 72 and a plurality of pins 74 that are electrically conductive extending through the plug 72. The plug 72 is sized to be received within the central bore 28 and located within the first portion 28*a* of the inner bore 28 of the body tube 22 and adjacent the second portion 28*b* of the inner bore 28. The switch assembly 24 is preferably contained within the first portion 28*a* of the inner bore 28. At least one pin in the plurality of pins 74 is electrically connected with the first circuit contact 64, and another pin in the plurality of pins 74 is electrically connected with the second circuit contact 66. Opposite ends of each of the pins in the plurality of pins 74 extend through a distal end wall of the plug 72 toward the open end 32 of the body tube 22. One pin in the plurality of pins 74 may be connected to a flexible connector, such as a pigtail 80, which is also connected with the common contact 60. Preferably, a seal plug 82 is sealingly disposed in a bore 84 that is axially aligned through the plug 72. In some applications, it may be desirable to eliminate the seal plug 82 to leave the bore 84 open or to eliminate the bore 84.

The pigtail 80 may be made of any electrically conductive material that is flexible an amount sufficient to allow the common contact 60 to move back and forth between the first and second circuit contacts, 64, 66. In a preferred embodiment, the pigtail is made of a flexible wire fabric. Other possible materials may include, for example, carbon fiber reinforced fabrics or plastics. Preferably, although not necessarily, the pigtail 80 is flexible an amount sufficient to minimize any mechanical bias of the piston head assembly 52 toward either of the first or second circuit contacts 64, 66 so that movement of the push/pull plunger assembly 46 is controlled substantially only by the various magnetic forces.

In operation, the magnets 34, 38, and 56 operate to bias the push/pull plunger assembly 46 into a normal first position toward the header assembly 70, in which the common contact 60 is biased into contact against the first circuit contact 64 and does not contact the second circuit contact 66. Preferably, the magnets 34, 38, 56 are selected and arranged to maintain uninterrupted contact between the common contact 60 and the first circuit contact 64 during a seismic acceleration loading of up to ten Gs. When a target magnet (not shown) is moved to within a selected minimum distance of the closed end 30 of the body tube 22 (e.g., less than 0.275 in), the attraction between the target magnet and the primary magnet 34 overcomes the biasing forces of the biasing magnets 38, 56 and pulls the primary magnet 34, and subsequently the entire push/pull plunger assembly 46, to a second position toward the closed end 30. In the second position, the common contact 60 is biased into contact against the second circuit contact 66 and does not contact the first circuit contact 64. Preferably, the space between the primary magnet 34 and the biasing magnet 38 is minimized by having only the end wall 44 and the end wall of the retainer 36 disposed between the two magnets, and the length of the shaft 54 is minimized accordingly, which provides a strong enough magnetic attraction between the magnets 34, 38 to help maintain the common contact 60 in uninterrupted contact with the first contact 64 at a seismic acceleration of up to 10 Gs. When the target magnet moves away from the closed end 30 of the body tube 22, the push/pull plunger assembly 46 resets to the first position (i.e., towards the header assembly 70) and the common contact 60 again contacts the first circuit contact 64. In one embodiment a movement of more than about 0.033 in away from the closed end 30 is sufficient to cause the push/pull plunger assembly 46 to reset. As the target magnet moves away from the closed end 30, the magnetic attraction between the target magnet and the primary magnet 34 decreases until the magnetic attraction between the target magnet and the primary magnet 34 is no longer sufficient to overcome the magnetic attraction between the primary magnet 34 and the biasing magnet 38 and/or the repelling force between the biasing magnet 38 and the second biasing magnet 56.

The end seal assembly 26 in a preferred arrangement provides a hermetic seal for the open end 32 of the body tube 22 to keep moisture and other harmful materials out of the switch assembly 24, while allowing electrical lead wires to be electrically connected with the contacts 60, 64, 66, and to be accessible for connection to control wiring and protecting the electrical lead wires from being pulled or moved in a manner that might compromise the various connections along the various circuits. The end seal assembly 26 includes a hermetic seal 90, a hollow crush ring 92, a crush ring compression device 94, a ferrule 96, a jam nut 98, and a potting 100, all preferably disposed in the second and third portions 28*b*, 28*c* of the inner bore.

The hermetic seal 90 includes a circular disc 102 with a plurality of holes and at least one hollow tube 104 disposed through each hole. Each hollow tube 104 has a first end disposed on an interior side of the disc 102 facing the switch assembly 24 and a second end disposed on an exterior side of the disc facing toward the open end 32. Each hollow tube 104 is arranged and has an inside diameter sized to receive an end of one pin in the plurality of pins 74 in a friction fit. Optionally, a fourth hollow tube 106 is disposed through the circular disc 102 and can be left open to conduct pressure testing prior to prior to sealing the end seal assembly 26 with the potting 100. The disc 102 seals with the second portion 28*b* of the inner bore 28 at a seal ring 108 sufficient to withstand specified pressure and other conditions. In one embodiment, the disc 102 may be formed of an electrically insulating material, such as glass, and the seal ring 108 may be formed of metal or other material that provides a good seal with the second portion 28*b*. The seal ring 108 may be soldered to the inner surface of the second portion 28*b*. The pins 74 preferably are attached to the respective one of the tubes 104 on the interior side of the disc 102 by, for example, soldering or welding.

A cable 110 may include a plurality of electrical wires 110*a*, 110*b*, and 110*c*, wherein each wire is connected with a respective one of the tubes 104 by, for example, an end pin that is received within the tube 104 and attached with solder. In one embodiment, the cable 110 may include six or more electrical wires for connection to various contacts of the double pole-double through connection. The cable 110 is arranged for being connected with control and/or sensing circuits elsewhere by completing the first and second circuits formed by the contacts 60, 64, 66, pins 74, and tubes 104. Of particular relevance for the purposes of this disclosure is that the cable 110 extends along the second and third portions 28*b*, 28*c* of the inner bore 28 from the tubes 104 to and out of the open end 32 of the body tube 22.

The crush ring compression device 94 is a plug that locks into the inner bore 28 by, for example, screwing into the third portion 28*c* of the inner bore 28, and has a central opening 112 through which the cable 110 extends. Preferably, the crush ring compression device 94 has a plug body 114 with exterior threads 116 that engage complementary threads 118 on the annular surface of the third portion 28*c* of the inner bore 28. The crush ring compression device 94 may include a cone-shaped outer surface that is complementary in slope to the cone-shaped inner surface 29*c* of the third portion 28*c* of the central bore 28. A nipple 120, preferably in the form of a short cylindrical section of smaller diameter than the plug body 114, projects axially from a central portion of an exterior side of the plug body 114 toward the open end 32. The nipple 120 may include external threads 121. The central opening 112 preferably defines a short cylindrical bore section 122 inside the nipple 120, an inner tapered portion 124 preferably in the form of an inner conical bore section extending from an inner end of the cylindrical bore section to the inner end of the plug body 114, and an outer tapered section 126 preferably in the form of an outer conical bore section extending from an outer end of the cylindrical bore section to an outer end of the nipple 120.

The crush ring 92 functions as a gasket seal between the inner end of the crush ring compression device 94 and a radially projecting inner annular ledge 128 of the body tube 22 that connects the second portion 28*b* and the third portion 28*c* of the inner bore 28. The crush ring 92 is made of a sealing material appropriate for the intended use environment of the proximity switch 20, and in one embodiment preferably is formed of a hollow stainless steel ring having the form of a hollow tube with a circular longitudinal axis, for use in harsh, high temperature, and/or nuclear environments. The crush ring 92 preferably has an outer diameter substantially equal to an inner diameter of the third portion 28*c* of the inner bore 28.

Potting 100 completely fills the space between the crush ring compression device 94 and the hermetic seal 90. Preferably, the potting 100 also seeps into and fills any space between the hermetic seal 90 and the end wall of the plug 72 of the header assembly 70. The potting 100 preferably is formed of a sealing material that can flow into or be compressed into all of the spaces and crevices to form a water-tight hermetic seal in the inner bore 28 to prevent at least liquids and harmful particulates from entering the switch assembly 24. In a preferred arrangement, the potting 100 is a flowable resin, such as an epoxy or similarly flowable material that subsequently sets or hardens.

In a preferred method of assembly, the potting 100 is inserted while in a fluid state into the inner bore 28 through the open end 32 after the switch assembly 24 and hermetic seal 90 are installed as described above. Preferably, the inner bore 28 is filled with enough potting 100 to completely fill all the space between the crush ring compression device 94 and the hermetic seal 90. In one method, the potting is filled to the thread 118 furthest from the open end 32 after the crush ring 92 is inserted into the inner bore 28, and the crush ring compression device 94 compresses the potting 100 to sealingly fill any crevices and openings around the crush ring compression device 94, such as between the threads 116 and 118 and between the cable 110 and the central opening 112. Preferably the potting 100 subsequently sets or hardens to form a solid sealing assembly or plug in the open end 32 of the body tube 22.

The ferrule 96 is an elongate tubular member that fits around the cable 110 and wedges into the outer tapered bore section 126. In a preferred arrangement, the ferrule 96 is made of PolyEtherEtherKetone (PEEK) and is bullet-shaped, having a cylindrical body 132 and a tapered nose 134 at one axial end, a radially inwardly tapered annular shoulder 136 at the opposite axial end, and an axial through bore 138 extending through the opposite axial ends.

The jam nut 98 holds the ferrule 96 in position wedged into the outer tapered bore section 126. The jam nut 98 preferably is formed of a cylindrical tube 142 having locking flanges 144, 146 at opposite axial ends of the cylindrical tube. Each locking flange 144, 146 projects radially inwardly from the respective axial end of the cylindrical tube 142. The locking flange 144 includes inner annular threads that engage the external threads on the nipple 120, and the locking flange 146 is sized to engage the annular shoulder 136 of the ferrule 96. The jam nut 98 fits over and around the ferrule 96, and the locking flange 146 presses against the annular shoulder 136 to urge the ferrule 96 into wedged engagement against the outer tapered bore section 126 as the locking flange 144 is screwed onto the nipple 120. Simultaneously, radially inwardly wedging force on the ferrule 96 from the outer tapered bore section 126 also tightens the ferrule 96 around the cable 110, thereby further forming a seal around the cable 110, which prevents liquid from wicking into the casing 22 when the proximity switch 20 is exposed to high pressures and/or liquid environments. The ferrule 96 and jam nut 98 also work together as assembly to lock the cable 110 in a fixed position within the central opening 112 to prevent movement or forces applied to the cable outside of the proximity switch 20 from being transferred to the various electrical connections with the switch assembly 24 at, for example the tubes 104, which could compromise the integrity of the electrical circuits.

In a preferred arrangement, the cylindrical jacket 35 may have one or more openings, such as windows 150, and preferably two opposing windows, through the sidewall of the casing arranged to allow visual inspection of the plunger assembly 46 and header 70 during assembly of the switch assembly 24. An insulating sleeve 152 may snugly around a portion of the exterior of the cylindrical jacket 35 to cover the windows 150 and reduce or prevent electrical arcing between the contacts 60, 64, 66 and the body tube 22. The insulating sleeve is preferably made of an electrically insulating material, such as Kapton® film by E.I. du Pont de Nemours and Company or similar materials, and has a longitudinal slit to aid in assembly. After being fitted onto the cylindrical jacket 35, opposite edges of the slit preferably are connected together by an adhesive patch, also preferably made of an insulating material, such as Kapton® tape by E.I. du Pont de Nemours and Company or similar materials.

In other embodiments, the proximity switch may include an optional flux sleeve in the form of a hollow metal cylinder, between the primary magnet 34 and the end wall 44 of the cylindrical jacket 35. The flux sleeve may be made of a ferrous material, which both separates the primary magnet 34 from the biasing magnet 38 to reduce the attractive magnetic pull between the magnets and focuses the magnetic flux field of the magnets. The flux sleeve may be attached to the cylindrical jacket 35 by a threaded connection with a threaded stud extending from the end wall 44 toward the primary magnet 34. The flux sleeve may be screwed on to the threaded stud. The attractive force between the primary magnet 34 and the biasing magnet 38 may be adjusted within a range of forces by varying the axial length of the flux sleeve and/or the material of the flux sleeve. In addition, the piston rod 54 in the proximity switch 20 may be lengthened in order to accommodate the added space required for the flux sleeve.

In yet other embodiments, the proximity switch may optionally not include the end seal assembly 46, and rather encapsulate the plug 72 and electrical cable 110 in the open end 32 of the body tube 22 with the potting 100 or other sealing material, such as an epoxy resin or plastic.

In still other embodiments, metal components may be replaced with carbon fiber or composite materials that pass the testing conditions described below. Additionally, other embodiments may include digital gap feedback, force feedback, magnetic pressure feedback, sensing distance display, and/or auto calibration. Finally, embodiments designed for low amperage systems may include contacts formed of gold or other low amperage contact materials.

While the proximity switches disclosed herein have generally circular cylindrical outer forms to easily allow the body tube 22 to be screwed into a common tapped cylindrical bore, the proximity switches 20 are not limited to being circular cylindrical. Rather, the components of the proximity switches 20 may have almost any cross-sectional shape as long as the primary magnet 34 and the push/pull plunger assembly 46 can move axially toward and away from a ferrous or magnetic target to move the common contact 60 from the first contact 64 to the second contact 66 and back as described herein.

The proximity switches disclosed herein are useful in industrial process control systems, and in some arrangements are particularly well adapted for use in nuclear applications, underwater, and in other caustic and/or harsh operating environments. The proximity switches disclosed herein are advantageously unaffected by weld fields or radio frequency interference. As a result, the disclosed proximity switches may be located in virtually any position within a control system. Additionally, the disclosed proximity switches are effective across a wide range of currents, especially in low current applications.

The disclosed proximity switches also exhibit very fast response times, generally less than 20 milliseconds, preferably less than 15 milliseconds and more preferably less than 10 milliseconds due to the nature of the magnetic detection of the target and magnetic actuation of the push/pull plunger assembly.

The disclosed proximity switches are also adaptable to a wide range of temperature environments. The disclosed proximity switches are capable of operation at temperatures between −40° C. and 495° C. due to the hermetically sealed components.

The disclosed proximity switches advantageously have no voltage drop when closed, and no voltage leakage when open.

Test Results

One example of the proximity switch described above was subjected to acceleration testing, temperature testing, and pressure testing, while maintaining contact continuity. The test conditions are summarized in FIGS. 3-7 and are described below.

Acceleration Testing

The proximity switch was subjected to front to back accelerations of up to 12.51 g at frequencies of up to 64 Hz, side to side accelerations of up to 14.54 g at frequencies of up to 64 Hz, and vertical accelerations of up to 10.44 g at frequencies of up to 64 Hz, all without losing contact continuity. The proximity switch also maintained contact continuity during multi-axis acceleration testing conducted in accordance with FIGS. 3-5.

Temperature Testing

Figure 6:
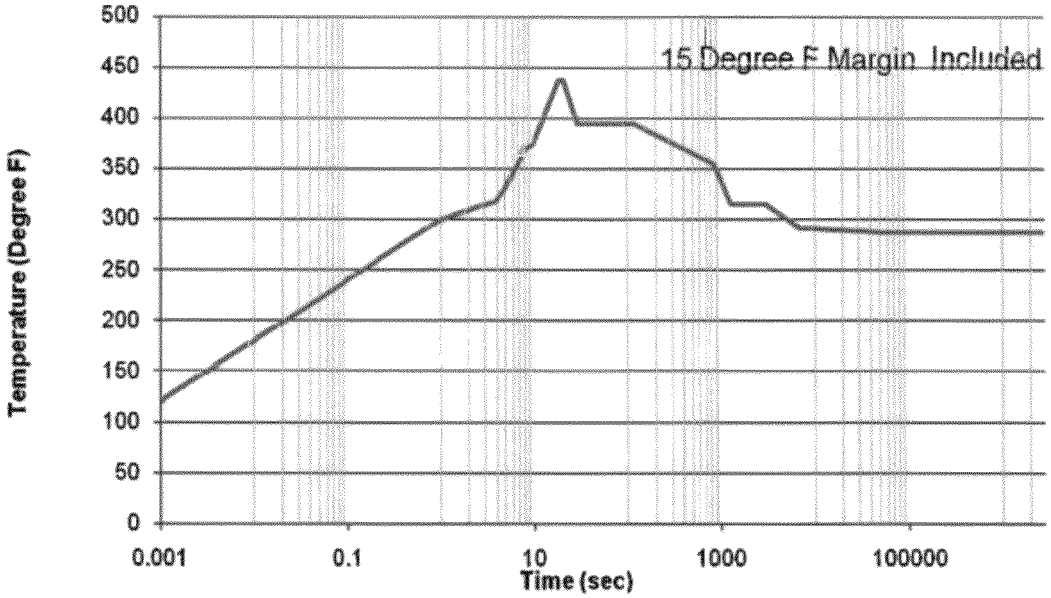
FIG. 6 is a graph of temperature testing of the proximity switch.

The proximity switch also maintained contact continuity during extreme temperature testing conducted in accordance with FIG. 6.

Pressure Testing

Figure 7:
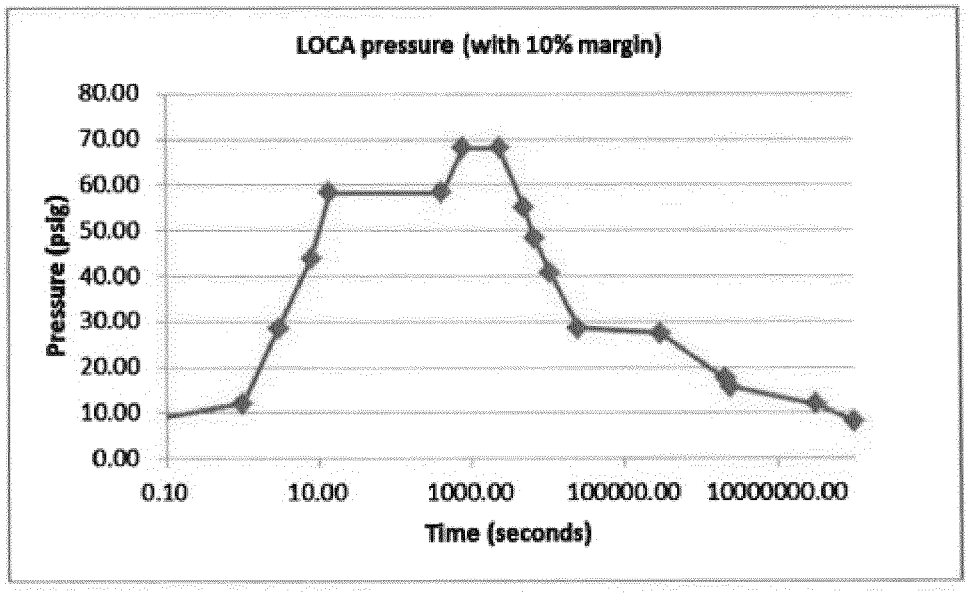
FIG. 7 is a graph of pressure testing of the proximity switch.

Finally, the proximity switch maintained contact continuity during pressure testing conducted in accordance with FIG. 7.

Numerous modifications to the proximity switches disclosed herein will be apparent to those skilled in the art in view of the foregoing description. Accordingly, this description is to be construed as illustrative only and is presented for the purpose of enabling those skilled in the art to make and use the proximity switches and to teach the best mode of carrying out same. The exclusive rights to all modifications which come within the scope of any claims are reserved. All patents, patent applications, and other printed publications identified in this foregoing are incorporated by reference in their entireties herein.

The invention claimed is:

1. A proximity switch comprising:

a body tube having a blind bore, a closed end, and an open end;

a magnetic switch assembly disposed inside the blind bore;

a hermetic seal covering the blind bore between the magnetic switch assembly and the open end;

a crush ring disposed against an annular shoulder defined in a surface of the blind bore between the hermetic seal and the open end;

a crush ring compression device having a threaded plug body that screws into the open end of the blind bore and sealingly engages the crush ring; and a potting filling space between the crush ring compression device and the hermetic seal, wherein the hermetic seal, the potting, and the crush ring compression device seal the blind bore and protect the magnetic switch assembly from exposure to harsh environmental factors.

2. The proximity switch of claim 1, wherein the crush ring is in the form of a hollow tube having a circular longitudinal axis.

3. The proximity switch of claim 1, wherein the hermetic seal includes a disc sized and shaped to complement the blind bore, and a tube extending through the disc.

4. The proximity switch of claim 3, wherein the tube includes a first end adjacent the magnetic switch assembly and an electrical contact.

5. The proximity switch of claim 3, wherein an outer annular periphery of the disc may be sealed to an inner surface of the blind bore.

6. The proximity switch of claim 3, wherein a second tube extends through the disc, and the second tube receives a second electrical contact.

7. The proximity switch of claim 1, wherein an electrical cable is connected to the magnetic switch assembly and the electrical cable extends from the hermetic seal through the crush ring compression device, the electrical cable being electrically coupled to the body tube.

8. The proximity switch of claim 1, wherein the crush ring compression device has a central bore, and an electrical cable extends through the central bore.

9. The proximity switch of claim 1, wherein the central bore includes a cylindrical portion and a first tapered portion extending from the cylindrical portion to a first end of the plug body.

10. The proximity switch of claim 1, wherein the crush ring compression device compresses the potting into the central bore.

* * * * *

UNITED STATES PATENT AND TRADEMARK OFFICE

CERTIFICATE OF CORRECTION

PATENT NO. : 9,053,880 B2
APPLICATION NO. : 13/728050
DATED : June 9, 2015
INVENTOR(S) : Robert Lynn LaFountain et al.

It is certified that error appears in the above-identified patent and that said Letters Patent is hereby corrected as shown below:

In the Specification:

At Column 3, line 16, “switch; and” should be -- switch. --.

At Column 4, line 30, “end wall 30” should be -- end wall 39 --.

At Column 8, line 62, “casing 22” should be -- casing --.

At Column 9, line 35, “piston rod 54” should be -- piston rod --.

Signed and Sealed this
Twenty-ninth Day of March, 2016

Michelle K. Lee

Michelle K. Lee
*Director of the United States Patent and Trademark Office*